United States Patent [19]

McClinton

[11] 4,296,859

[45] Oct. 27, 1981

[54] PIGMENT PACKAGE

[75] Inventor: John L. McClinton, Hanover, Md.

[73] Assignee: The Burns and Russell Company, Baltimore, Md.

[21] Appl. No.: 68,599

[22] Filed: Aug. 22, 1979

[51] Int. Cl.[3] ..... B65D 81/32; B32B 7/02; C08L 51/00

[52] U.S. Cl. ..... 206/219; 206/447; 206/591; 206/524.7

[58] Field of Search ..... 206/219, 447, 524.7, 206/524.9, 524.6, 591; 220/403

[56] References Cited

U.S. PATENT DOCUMENTS

| | | | |
|---|---|---|---|
| 666,452 | 1/1901 | Zucker | 206/524.9 |
| 2,047,385 | 7/1936 | Sanders | 206/447 |
| 2,364,943 | 12/1944 | Brandt | 220/403 |
| 2,572,959 | 10/1951 | Sparks et al. | 206/447 |
| 3,784,005 | 1/1974 | McVay | 206/219 |
| 3,902,596 | 9/1975 | McVay | 206/219 |
| 4,112,158 | 9/1978 | Creekmore et al. | 206/524.7 |

*Primary Examiner*—William T. Dixson, Jr

*Attorney, Agent, or Firm*—Cushman, Darby & Cushman

[57] ABSTRACT

Pigmented liquid 100% unsaturated polyester of the reactive type is packaged in oriented polystyrene film container inside an external container. The polystyrene container can then be placed in a monomer which dissolves it to release the pigmented polyester.

12 Claims, 6 Drawing Figures

PIGMENT PACKAGE

Figure 1:
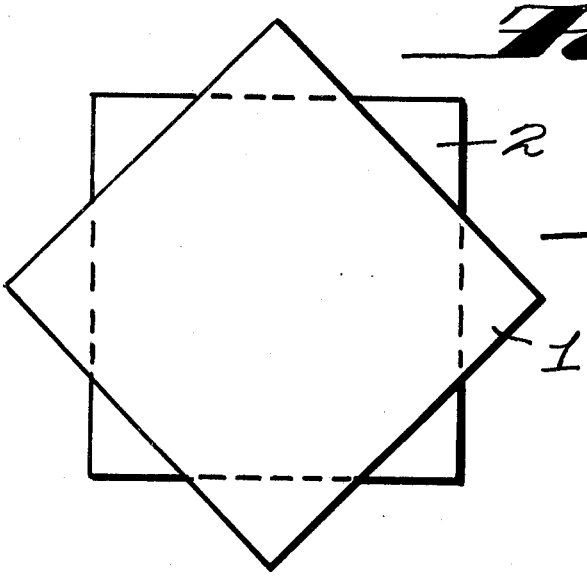
Figure 2:
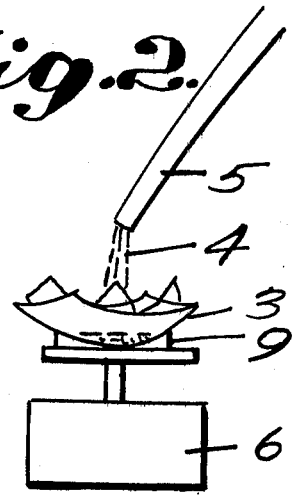

This invention relates to a novel method for packaging and using pigmented unsaturated polyester resins.

Unsaturated polyester resins containing pigments are useful in preparing glazed masonry units and various monolithic cast articles as well as for numerous other uses, e.g. see Sergovic U.S. Pat. No. 4,031,289, McClinton U.S. Pat. No. 4,031,282, Sergovic U.S. Pat. No. 3,328,231, McClinton U.S. Pat. No. 3,030,234, Russell U.S. Pat. No. 3,078,249, Sergovic U.S. Pat. No. 2,962,052, Russell U.S. Pat. No. 2,814,836, Ruskin U.S. Pat. No. 2,757,275 and Sergovic U.S. Pat. No. 2,751,775. The entire disclosures of these nine patents is hereby incorporated by reference and relied upon.

Difficulties are sometimes encountered in utilizing the pigmented unsaturated polyester. The pigmented unsaturated polyester is a viscous paste and does not flow. Therefore it is difficult to remove all of the composition from the shipping container. If the pigmented unsaturated polyester also contains liquid unsaturated monomer, e.g. styrene, methyl methacrylate, p-methyl styrene or alpha-methyl styrene there are problems because of reaction with the pigmented polyester.

It has now been found that the problems previously associated with the packaging and use of pigmented unsaturated polyester resins can be eliminated if pigmented liquid 100% unsaturated polyester is packaged in a polystyrene container and then to make up the final composition the entire package is dissolved in a polymerizable solvent for polystyrene which solvent is also capable of reacting with the unsaturated polyester. The preferred solvent is monomeric styrene. Another suitable solvent is methyl methacrylate.

The pigmented unsaturated polyester should be in the form of a viscous paste which does not exhibit slump flow. By slump flow is meant that when the pigmented unsaturated polyester is placed on a spatula and the spatula is suspended in the vertical position the composition does not drip for at least two seconds.

There can be added thixotropic agents to the pigmented polyester to help insure the required high viscosity. Thus there can be used pyrogenic silica such as Cabosil or Aerosil in an amount of 0–3 parts per 100 parts of total of pigment and polyester. Usually there is employed 0.1–0.3 parts of the thixotropic agent.

There can be employed any of the conventional pigments, e.g. titantium dioxide, phthalocyanine blue, phthalocyanine green, monastral blue, ochre, red iron oxide, zirconium oxide, burnt sienna, black iron oxide, yellow iron oxide, chronium oxide, chrome orange, moly orange, zinc yellow, cadmium red, iron blue, e.g. Prussian blue, ultramarine, cobalt blue, cadmium yellow.

The ratio of pigment to unsaturated polyester is not critical but depends upon the use. It can range from 25 to 70% of pigment based on the total of pigment and polyester, and preferably 50 to 65%. The ratio of the total weight of monomer subsequently added and to polyester also is not critical and can be the same as the amount of monomer conventionally used in the art, e.g. after addition of monomer 15 to 85% of the total of monomer, and polyester can be monomer and the balance polyester.

The polystyrene is normally oriented so that it can be krinkled. The orientation can be uniaxial or biaxial. Preferably biaxially oriented polystyrene is employed.

The presently preferred material is Trycite, a biaxially oriented polystyrene produced by Dow.

The polystyrene usually has a thickness of 1–2 mils but other thickness films can be used.

While a single thickness of polystyrene can be employed to make the polystyrene container for the pigmented polyester, preferably there are utilized two pieces of polystyrene film to make the container. The use of two thickness has advantages in forming the container, e.g. it gives better support at the edges, added protection in case of breakage in transit or handling.

The oriented polystyrene film holds the pigmented polyester in place. It also provides a cushioning effect and added protection when shipped, e.g. when it is krinkled it acts as a shock absorber similar to foamed plastic.

Those polyester resins which can be used are ethylenically unsaturated alkyd resins. Among the dicarboxylic acids which may be used as phthalic, isophthalic, malic, maleic, fumaric, adipic, pimelic, suberic, sebacic, itaconic, citraconic and succinic acids and their anhydrides where they exist. It is essential that some of the dicarboxylic acid component of the polyester resin contain an unsaturated ethylenic linkage. For this reason, maleic and fumaric acids are most desirable. Among the polyhydric alcohols which may be used include ethylene glycol, diethylene glycol, propylene glycol, dipropylene glycol and neopentyl glycol. One may use an unsaturated monohydric alcohol in place of part of the polyhydric alcohol. A typical example of such an alcohol is allyl alcohol which produces an allyl ester of the dicarboxylic acid.

There can be used any of the polyhydric alcohols and polycarboxylic acids set forth in the nine above mentioned patents to make the unsaturated polyesters and there can be used any of the unsaturated polyesters mentioned in those patents.

Unless otherwise indicated, all parts and percentages are by weight.

The packaged pigmented polyester can be packed for shipment in any external container, e.g. a polyethylene, polypropylene, cardboard or other container.

The unsaturated polyester and pigment composition should be free from catalyst capable of causing polymerization through a double bond.

The method can consist essentially of or consist of the steps set forth with the materials set forth.

The pigmented unsaturated polyester can consist essentially of or consist of the materials set forth. The term consist essentially of does not exclude materials inert to the pigment, polyester and/or thixotropic agent. It does exclude polymerizable monomers, ethylenic polymerization catalysts and other materials which will react with any of the essential ingredients.

In the following example there was used a 100% unsaturated polyester, resin in liquid form which is highly reactive. Specifically there was employed MR1208-A pigment grinding vehicle manufactured by USS Chemicals.

The pigmented polyester had the following composition.

COMPOSITION I

| | |
|---|---|
| $TiO_2$ | 6 parts |
| Polyester (100% unsaturated liquid polyester) | 4 parts |

-continued

| COMPOSITION I | |
|---|---|
| Cabosil | 0.3 parts |

In use this composition is packaged in the biaxially oriented polystyrene film. Then for example the entire package is placed in styrene monomer formulation to provide 3 parts of Composition I, 20 parts styrene and 80 parts unsaturated polyester which is Resin formulation A of Sergovic U.S. Pat. No. 4,031,789 which is as follows:

| Resin Formulation A | | |
|---|---|---|
| | Mols | % Maleic Anhydride in Finished Resin |
| Neopentyl Glycol | 1.02 | |
| Isophthalic Acid | 0.5 | |
| Maleic Anhydride | 0.5 | 23.2% |

In the example both biaxially oriented styrene films were 1 mil thick.

As previously indicated it is essential to create a cushion effect if, as is ordinarily the case, the external container, e.g. polyethylene, cardboard, etc. is not the same size as the internal polystyrene container.

When phthalocyanine blue is the pigment the amount of Cabosil is normally 0 to 0.1 part per 100 parts of pigment and polyester.

The invention will be understood best in connection with the drawings wherein

FIGS. 1 through 6 show six successive steps in forming the package article of the invention.

Referring more specifically to the drawings wherein like numerals refer to like parts there are provided two pieces 1 and 2 of 1 mil biaxially oriented polystyrene film (which polystyrene is soluble in styrene monomer). While the two layers of film are shown as squares, and this is the preferred form, they can be of rectangular or other shape. The two layers of film are also preferably crossed in the manner indicated.

The two layers of film are placed in a holder 9 made of soft preformed wire in the nature of a foamed basket and the basket is placed on a scale 6 which is electronically wire to a pump (not shown). The scale is rated to zero. Pigmented unsaturated polyester 4 (e.g. Formulation I) is pumped through conduit 5 into the pocket formed in the polystyrene layered film 3 until a cutoff point on the scale which electronically trips the pump.

Figure 3:
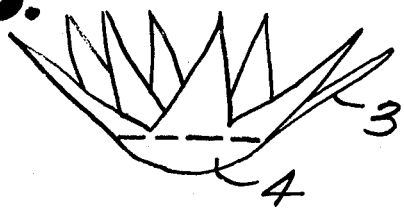
Figure 4:
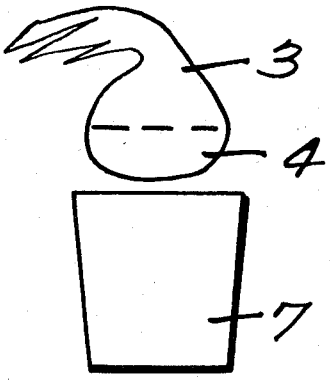
Figure 6:
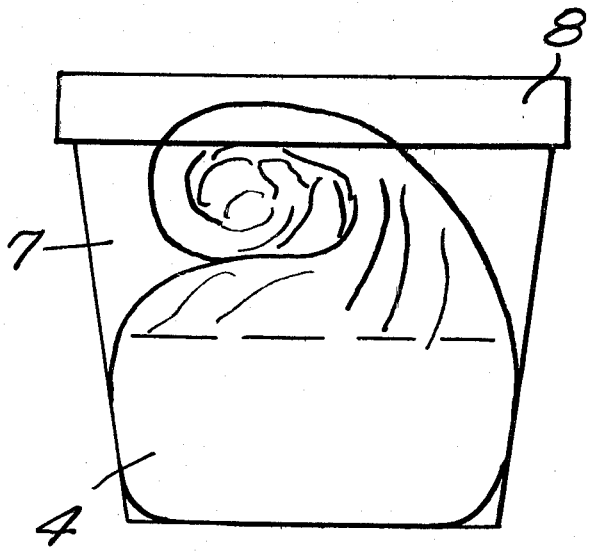
Figure 5:
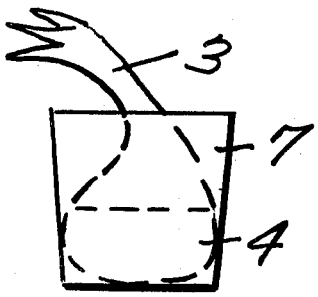

The film containing the pigmented polyester is lifted out of the basket (FIG. 3). The loose portions of the film are folded together and readied in place to put in outer container 7, e.g. of polyethylene.

The pigmented polyester in the layered film 3 is placed in the polyethylene container and manual crimping of the film begins. (Crimping of course can be done mechanically). The top edges of the film are folded and crumpled to contain the pigment so it cannot fall out and to fill the external container 7 to prevent the internal package from moving unnecessarily. Then cover 8 is placed on the external container 7 and it is ready for shipment.

At the point of use the cover 8 is removed and the biaxially oriented polystyrene inner package containing the pigmented polyester is dropped into monomeric styrene to dissolve the polystyrene and release the pigment to color the final product.

If there is not sufficient polyester in the pigmented polyester composition then there can be added more of the same or a different unsaturated polyester in the styrene monomer.

The product can be worked into a cured product and used in the manner disclosed in any of the aforementioned patents.

What is claimed is:

1. A package comprising an external rigid container, a removable lid for said rigid container, an internal container suitable to be filled into and removed from the rigid container as an assembly, said internal container including an oriental polystyrene film having a pigmented 100% liquid unsaturated reactive polyester resin therein in the form of a viscous substantially non-flowing paste, the film of said internal container being in at least partially krinkled condition within said rigid container, the volume of said paste being sufficiently less than the volume of said external rigid container with said lid thereon that the remaining volume when filled with said krinkled film of the internal container that it acts as a cushion and shock absorber during transportation and prevent the internal container from moving unnecessarily while permitting ready removal of said internal container from said external container.

2. A package according to claim 1 wherein the polystyrene is biaxially oriented polystyrene.

3. A package according to claim 2 wherein in addition to the pigment and 100% liquid polyester there is present a thixotropic agent.

4. A package according to claim 1 wherein there is present a thixotropic agent.

5. A package according to claim 3 wherein the thixotropic agent is pyrogenic silica.

6. A package according to claim 1 wherein the polystyrene container is made of a single sheet of polystyrene film.

7. A package according to claim 1 wherein the polystyrene container is made of two rectangular, crossed sheets of polystyrene film to form an internal container having an upper portion containing eight points of single thickness and a lower portion of two thicknesses.

8. A package according to claim 7 wherein both films having a thickness of 1–2 mils.

9. A package according to claim 7 wherein the two rectangular crossed sheets are squares.

10. A package according to claim 1 wherein the paste is sufficiently viscous that it does not exhibit slump flow.

11. A method of forming a package comprising placing an oriented polystyrene film in a holder to form a pocket, filling a pigmented 100% liquid unsaturated reactive polyester resin in the form of a viscous substantially non-flowing paste into the pocket, removing the paste containing film from the holder, folding the loose portions of the film and placing the film in an external rigid container, folding and crumpling the top edges of the film to contain the paste and form an internal container and to fill the external container and placing a lid on the external container.

12. A method according to claim 11 wherein the polystyrene container is made of two rectangular sheets of polystyrene film and the process comprises the step of crossing the two sheets to form an outer portion containing eight triangles of single thickness and an inner portion in the form of an octagon of two thicknesses prior to filling the film with paste.

* * * * *